US010316809B2

(12) United States Patent
Madsen et al.

(10) Patent No.: US 10,316,809 B2
(45) Date of Patent: Jun. 11, 2019

(54) FUEL INJECTION SYSTEM FOR AN INTERNAL COMBUSTION ENGINE

(71) Applicant: Neander Motors AG, Kiel (DE)

(72) Inventors: Erik Madsen, Quarnbek (DE); Rupert Baindl, Geretsried (DE)

(73) Assignee: Neander Motors AG, Kiel (DE)

( * ) Notice: Subject to any disclaimer, the term of this patent is extended or adjusted under 35 U.S.C. 154(b) by 0 days.

(21) Appl. No.: 15/657,602

(22) Filed: Jul. 24, 2017

(65) Prior Publication Data

US 2018/0030942 A1 Feb. 1, 2018

(30) Foreign Application Priority Data

Jul. 27, 2016 (DE) ..... 10 2016 009 079

(51) Int. Cl.

| | |
|---|---|
| ***F02M 61/14*** | (2006.01) |
| ***F02B 3/12*** | (2006.01) |
| ***F02M 39/00*** | (2006.01) |
| ***F02M 55/02*** | (2006.01) |

(Continued)

(52) U.S. Cl.

CPC ..... *F02M 61/145* (2013.01); *F02B 3/12* (2013.01); *F02M 39/005* (2013.01); *F02M 55/02* (2013.01); *F02M 61/14* (2013.01); *B05B 1/3066* (2013.01); *F02F 2001/246* (2013.01); *F02M 2200/855* (2013.01)

(58) Field of Classification Search

CPC .... F02M 61/14; F02M 61/145; F02M 39/005; F02M 55/02; F02M 2200/85; F02M 2200/855; F02B 3/12

USPC ..... 123/195 A, 470

See application file for complete search history.

(56) References Cited

U.S. PATENT DOCUMENTS

| | | | | |
|---|---|---|---|---|
| 4,246,877 A * | 1/1981 | Kennedy | ..... | F02M 61/14 123/470 |
| 6,845,758 B2 * | 1/2005 | Seymour, II | ..... | F02M 61/14 123/470 |
| 2014/0041385 A1 | 2/2014 | Wittwer | | |

FOREIGN PATENT DOCUMENTS

| | | |
|---|---|---|
| DE | 10 2012 015 907 B3 | 10/2013 |
| JP | 3-182680 A | 8/1991 |

* cited by examiner

*Primary Examiner* — Hai H Huynh
*Assistant Examiner* — Gonzalo Laguarda
(74) *Attorney, Agent, or Firm* — Crowell & Moring LLP

(57) ABSTRACT

A fuel injection system designed for an internal combustion engine includes at least one fuel injection nozzle which, by way of a cylindrical shell body, is inserted at least in regions into a bore of a cylinder head and which, by way of a nozzle tip, feeds fuel to a combustion chamber between the cylinder head and a reciprocating piston. The fuel injection nozzle is held in position on a housing section of the internal combustion engine with the interposition of a holding device and, for example, a fastening bolt. The holding device braces a first end region of the fuel injection nozzle against a bore stop within the bore in the cylinder head. To optimize this fuel injection system, the holding device has, outside the bore, a fixing bushing to which the shell body is fixed axially and radially by way of a radial insert element. A spring system acts between a first radial stop of the fuel injection nozzle and a second radial stop of the fixing bushing as viewed in the axial direction of the shell body of the fuel injection nozzle. The spring system seeks to move the fixing bushing, by way of a third radial stop, against a locking element system of the insert element, which is supported on a fourth radial stop applied to the shell body.

16 Claims, 8 Drawing Sheets

(51) Int. Cl.

| | |
|---|---|
| *B05B 1/30* | (2006.01) |
| *F02F 1/24* | (2006.01) |

FUEL INJECTION SYSTEM FOR AN INTERNAL COMBUSTION ENGINE

CROSS REFERENCE TO RELATED APPLICATIONS

This application is claims priority under 35 U.S.C. § 119 from German Patent Application No. 10 2016 009 079.0, filed Jul. 27, 2016, the entire disclosure of which is herein expressly incorporated by reference.

BACKGROUND AND SUMMARY OF THE INVENTION

The invention relates to a fuel injection system for an internal combustion engine, comprising at least one fuel injection nozzle.

A device is known, from JPH03182680 A, in which a fuel injection nozzle of an internal combustion engine is arranged in a bore of a cylinder head. The device has a holding device which is designed in the manner of a two-arm lever and which engages at one side with a first arm on a collar-like stop of the fuel injection nozzle and at the other side with a second arm on a bolt head of a cylinder head bolt. A fastening bolt extends between the two arms, which fastening bolt is screwed into a thread in the cylinder head and braces the fuel injection nozzle against a stop in the bore of the cylinder head with the interposition of a seal. Furthermore, a nozzle tip of the fuel injection valve extends through a passage opening in the cylinder head and is thereby connected to a combustion chamber of the internal combustion engine.

DE 195 54 065 A1 discloses an assembly for fastening an injection nozzle in a holder which is equipped with a receiving opening for the injection nozzle. A bracing element is attached to the injection nozzle. By means of fastening bolts, the bracing element is connected to the holder, specifically such that the injection nozzle bears with a force fit against a stop in the receiving opening. A sealing disk is installed between the injection nozzle and stop. Also, a nozzle tip of the injection nozzle extends through a passage bore in the holder, such that fuel can be introduced into a downstream combustion chamber.

It is an object of the invention, for a fuel injection nozzle of a fuel injection system which operates in an internal combustion engine, to devise measures which firstly hold the fuel injection nozzle securely in position on the internal combustion engine and which secondly promote simple installation of said fuel injection nozzle. Here, it should however also be sought to achieve that the measures can be implemented with means which substantially involve little outlay.

According to the invention, said object is achieved by a fuel injection system for an internal combustion engine, comprising at least one fuel injection nozzle which, by way of a cylindrical shell body, is inserted at least in regions into a bore of a cylinder head and which, by way of a nozzle tip, feeds fuel to a combustion chamber between the cylinder head and a reciprocating piston. The fuel injection nozzle is held in position on a housing section of the internal combustion engine with the interposition of a holding device, which holding device braces a first end region of the fuel injection nozzle against a bore stop within the bore in the cylinder head. The holding device has, outside the bore, a fixing bushing to which the shell body is fixed axially and radially by way of a radial insert element. A spring system acts between a first radial stop of the fuel injection nozzle and a second radial stop of the fixing bushing as viewed in the axial direction of the shell body of the fuel injection nozzle. The spring system seeks to move the fixing bushing, by way of a third radial stop, against a locking element system of the insert element, which is supported on a fourth radial stop applied to the shell body.

The main advantages achieved by the invention can be seen in that it is exemplary from a design aspect that the holding device of the fuel injection nozzle has, outside the bore in the cylinder head, the fixing bushing to which the shell body of the injection valve is fixed axially and radially by the radial insert element. Here, the spring system acts between the first radial stop of the fuel injection nozzle and the radial stop of the fixing bushing as viewed in the axial direction of the shell body. The spring system seeks to move the fixing bushing, by way of a third radial stop, against the locking element system of the insert element, which is supported on the fourth radial stop applied to the shell body.

It is exemplary that the insert element is in the form of a U-shaped fixing clip which is made up of two parallel limbs and a transverse web which connects said limbs, the limbs of the first and second locking elements and the transverse web forming the third locking element. In this regard, it is to be emphasized that at least the first and second locking elements have a square cross section. It is expedient from a structural aspect that the first and second locking elements have inner delimitations and outer delimitations as viewed in the radial direction of the metal body of the fuel injection nozzle. The inner delimitations interact with first flattened portions of the metal body and the outer delimitations interact with second flattened portions of the fixing bushing. For optimization of the fixing clip, it is also conducive that its transverse web is, as viewed in the radial direction of the shell body, fixed by an axial securing collar of the fixing bushing.

With regard to the spring system, standards are set by the fact that it is formed in a ring-shaped manner between the first stop of the shell body and the second stop of the fixing bushing. This is achieved in that the spring system is formed by a spring device composed of rubber or elastomer and a compression spring composed of spring steel, which spring device and compression spring are situated one behind the other as viewed in the axial direction, the compression spring being supported against the first stop and the spring device being supported against the second stop. It is also of note that the spring device is of double-T-shaped form in cross section and, by way of the limbs connected to the transverse web, acts as a sealing body between the first flattened portions of the shell body and the second flattened portions.

A design which is sophisticated from a strength aspect can be realized in that the fixing bushing is, in the direction of the second end region of the fuel injection nozzle, equipped with a jacket cup which has a first, conical shell section leading away from the fixing bushing, with a second, cylindrical shell section adjoining said first shell section. Furthermore, the second shell section is neatly delimited by the support flange.

An excellent design is realized in that the fixing bushing, the first shell section and the second shell section are combined as a high-strength bearing bracket produced in one piece. A further possible use of the bearing bracket is made possible by virtue of the bearing bracket being designed for receiving two fuel injection nozzles, wherein a single fastening bolt which extends, in a central longitudinal plane between the injection nozzles, through a bracket bore, which is surrounded by a turned-up reinforcement of the bearing bracket, serves for fastening the bearing bracket to the housing section of the internal combustion engine. It is also expedient that a sealing device is provided between the support flange and a contact plane of the housing section. It is groundbreaking from a manufacturing aspect that the bearing bracket, the fuel injection valves, the spring systems and the insert elements form a prefabricated structural unit.

Finally, for the installation of the fixing clips, which are in the form of insert elements, an ingenious method is suitable in which the spring systems and, subsequently, the fuel injection nozzles are inserted into the fixing bushings of the bearing bracket. The respective fixing clips then are subjected, via the first stop, to load in the axial direction of the fuel injection nozzle such that the insert element can be inserted radially, in such a way that the securing collar of the fixing bushing engages over the transverse web of the fixing clip such that the fixing clip is radially secured after the spring system is relieved of load.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
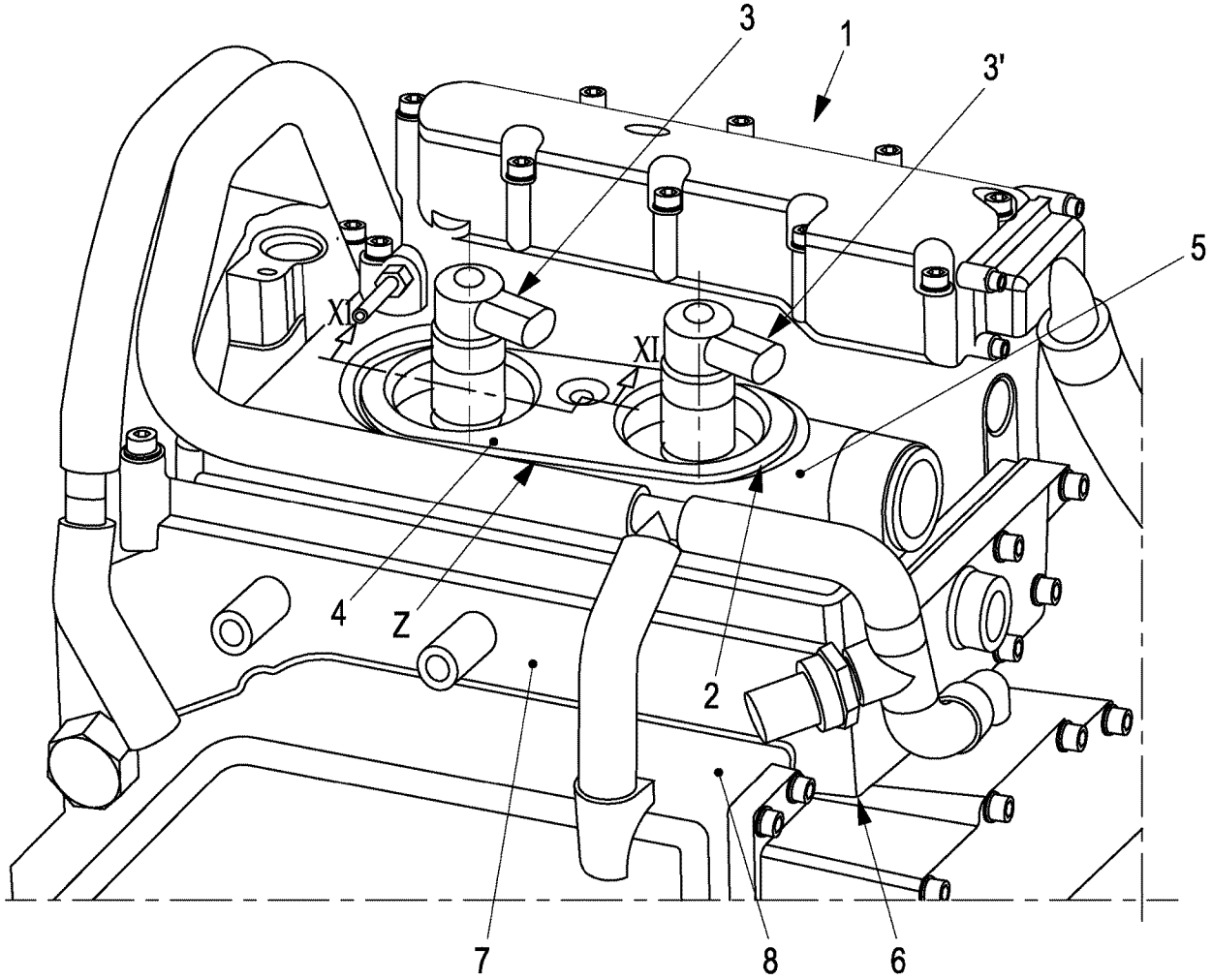
FIG. 1 shows a partial oblique view of an internal combustion engine with an indicated fuel injection system which has at least one fuel injection nozzle.

An internal combustion engine 1, of a reciprocating-piston type of construction, which is suitable for use in land vehicles, watercraft or the like, has a fuel injection system 2 for diesel or gasoline and is equipped with at least one fuel injection nozzle 3. The fuel injection nozzle 3 is attached, with the interposition of a holding device 4, to a housing section 5 of an engine housing 6 of the internal combustion engine 1. More details regarding the internal combustion engine 1 emerge from DE 10 2012 015 907 B3, the engine housing of which likewise has a cylinder head 7 and a cylinder crankcase 8.

The fuel injection nozzle 3 is equipped with a cylindrical shell body 9 which is inserted at least in regions into a bore 10 of the cylinder head 7 and, by way of a nozzle tip 11, feeds fuel to a combustion chamber 12 between cylinder head 7 and a reciprocating piston 13. Also, the fuel injection nozzle 3 is held on the housing section 5 of the engine housing 6 by the holding device 4 and, for example, a fastening bolt 15. A first end region 16 of the fuel injection nozzle 3 is braced—FIG. 2—against a bore stop 17 within the bore 10 in the cylinder head 7 by way of the holding device 4, wherein a sealing element may be provided between bore stop 17 and first end region 16.

Figure 3:
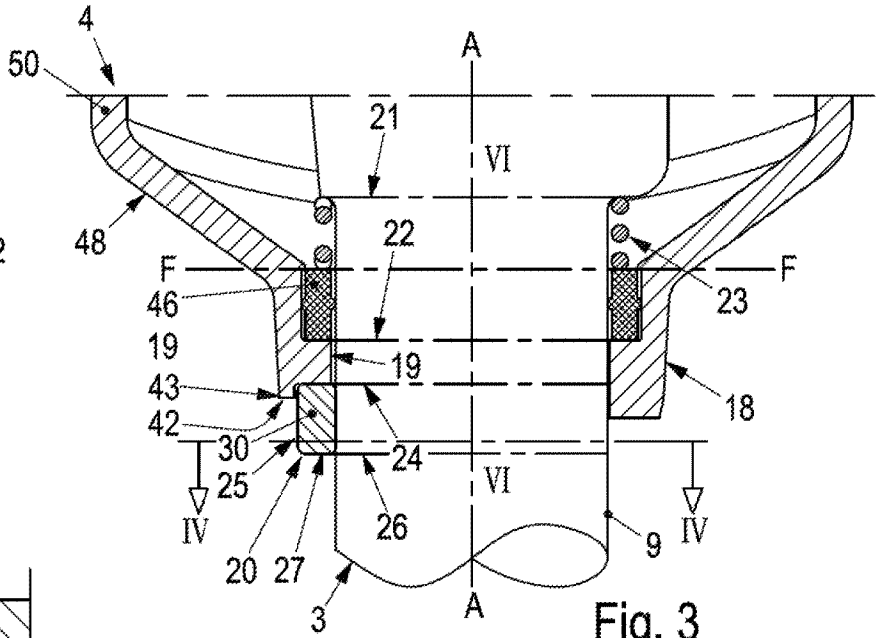
FIG. 3 shows a detail Y of FIG. 2 on an enlarged scale and partially in section with the insert element.
Figure 4:
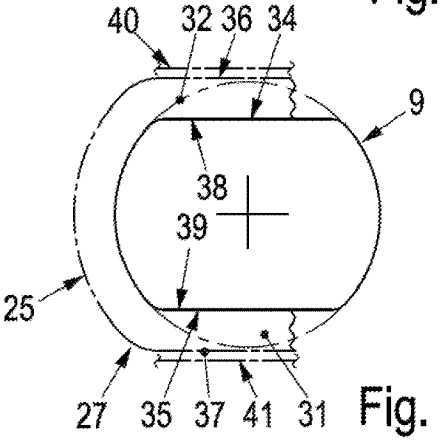
FIG. 4 shows a section approximately along the line IV-IV of FIG. 3.
Figure 2:
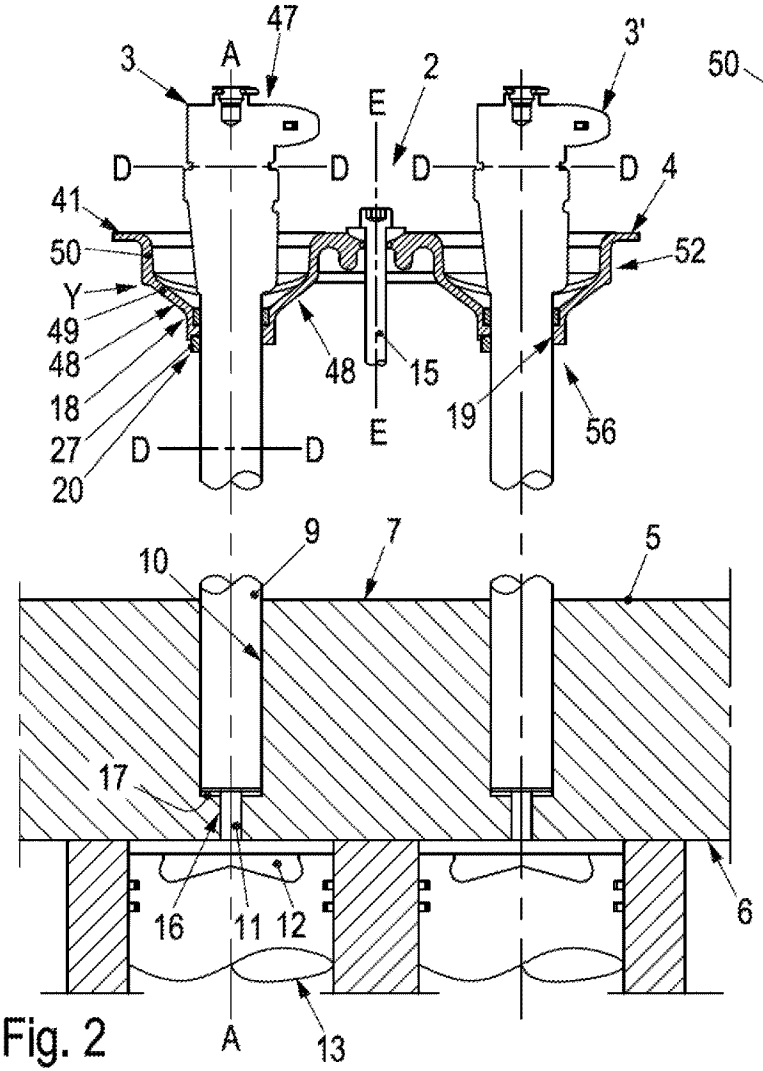
FIG. 2 shows a detail X of FIG. 1 partially in section and on an enlarged scale with at least one insert element for axially and radially securing the fuel injection nozzle as per FIG. 1.
Figure 5:
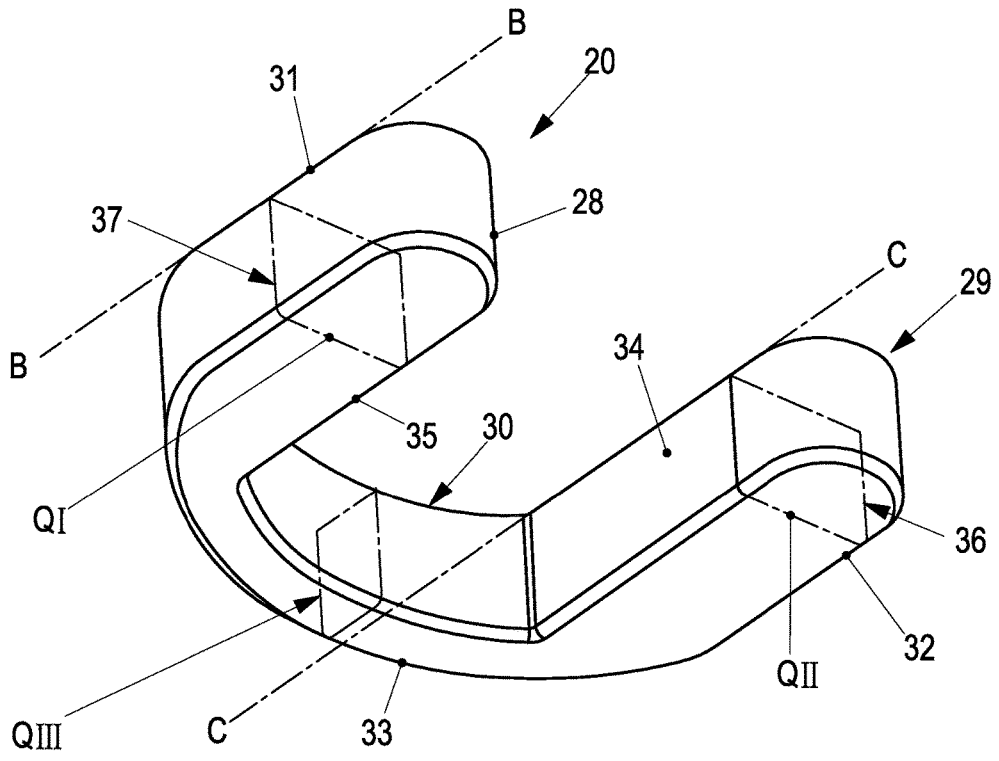
FIG. 5 shows an oblique view of the insert element as per FIG. 2 on its own.

Outside the bore 10, there is provided on the holding device 4—FIGS. 2 and 3—a fixing bushing 18 which, by way of an internal bore 19, surrounds the shell body 9. The fuel injection nozzle 3 or the shell body 9 is fixed axially and radially to the fixing bushing 18 with the interposition of a radial—relative to the axial direction A-A of the fuel injection nozzle 2 or the shell body 9—insert element 20. As viewed in the axial direction A-A of the shell body 9 of the fuel injection nozzle 3, a spring system 23 acts between a first radial stop 21 of the fuel injection nozzle 3 and a second radial stop 22 of the fixing bushing 18. The spring system 23 seeks to move the fixing bushing 18, by way of a third radial stop 24, against a locking element system 25 of the insert element 20, which is supported on a fourth radial stop 26 of the shell body 9. The insert element 20 is in the form of a U-shaped fixing clip 27—FIGS. 4 and 5—which is made up of two parallel limbs 28 and 29 and of a transverse web 30 which connects the limbs. The limbs 28 and 29 form first and second locking elements 31 and 32; the transverse web 30 forms a third locking element 33. The locking elements 31 and 32, which are situated in planes B-B and C-C, are each provided with a square cross section QI and QII. By contrast, the cross section QIII of the third locking element 33 may be rectangular, and the latter surrounds the shell body 9—FIG. 4—in arcuate fashion.

The first and second locking elements 31 and 32 have inner delimitations 34 and 35 and outer delimitations 36 and 37 as viewed in a radial direction D-D of the fuel injection nozzle 2 or of the shell body 9. The inner delimitations 34 and 35 interact with first flattened portions 38 and 39 of the shell body 9, and the outer delimitations 36 and 37 interact with second flattened portions 40 and 41 of the fixing bushing 18—FIG. 4. The transverse web 30 of the fixing clip 27 is, as viewed in the radial direction D-D—FIG. 2—of the shell body 9, fixed by way of an axial securing collar 42—FIG. 3—of the fixing bushing 18 in the radial direction D-D, which securing collar 42 is applied adjacent to an outer circumference 43 of the fixing bushing 18.

Figure 6:
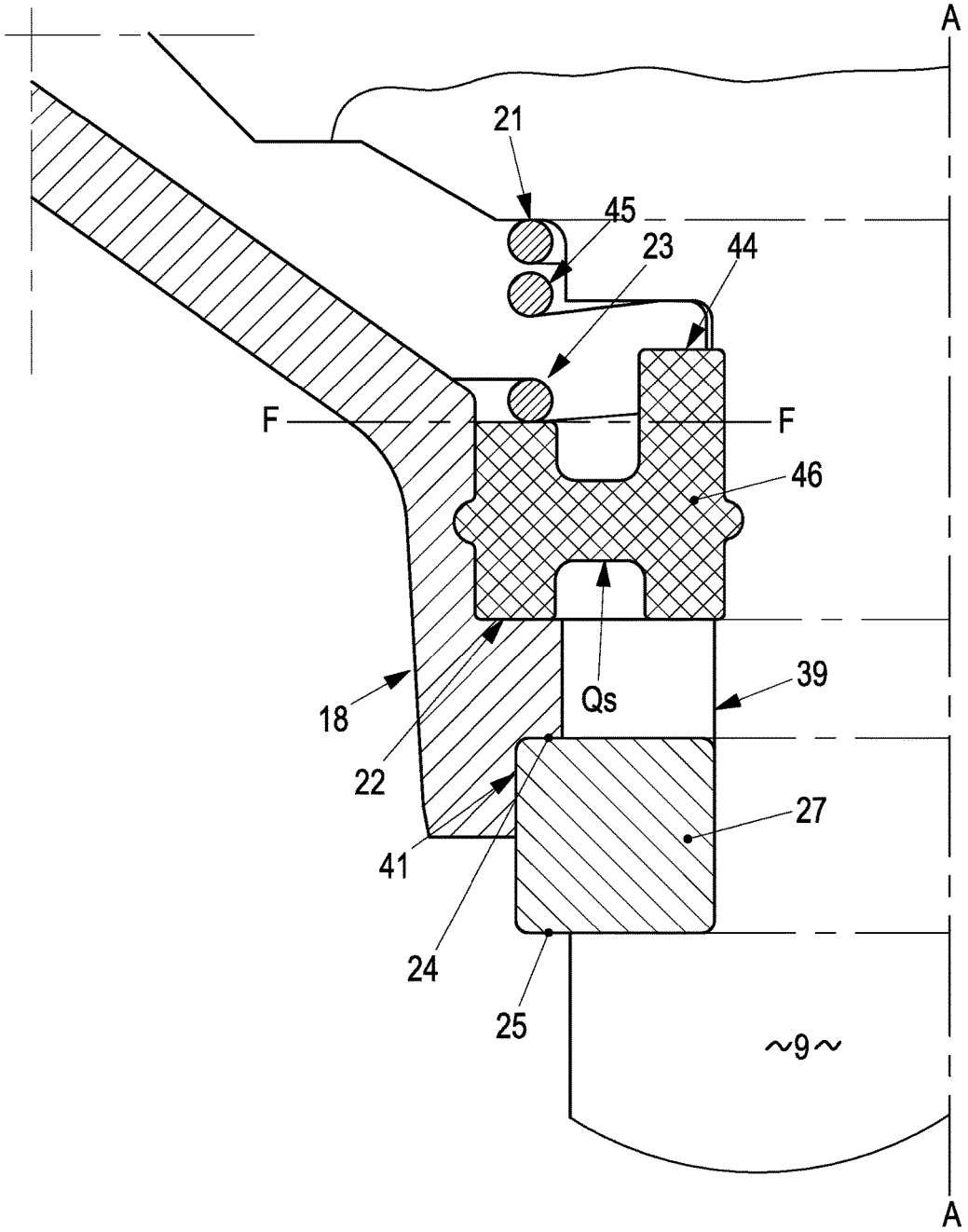
FIG. 6 shows a section approximately along the line VI-VI of FIG. 3 on an enlarged scale.
Figure 8:
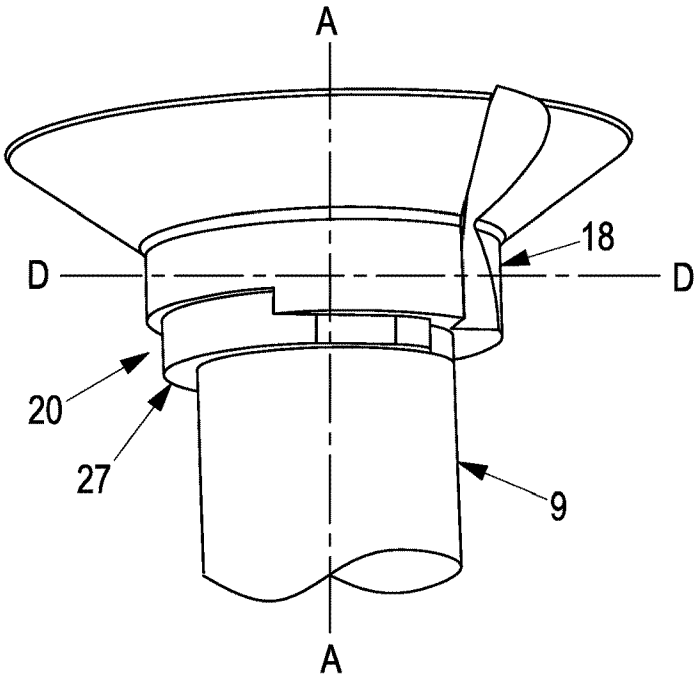
FIG. 8 shows a second installation position of the insert element as per FIGS. 2 and 3.
Figure 7:
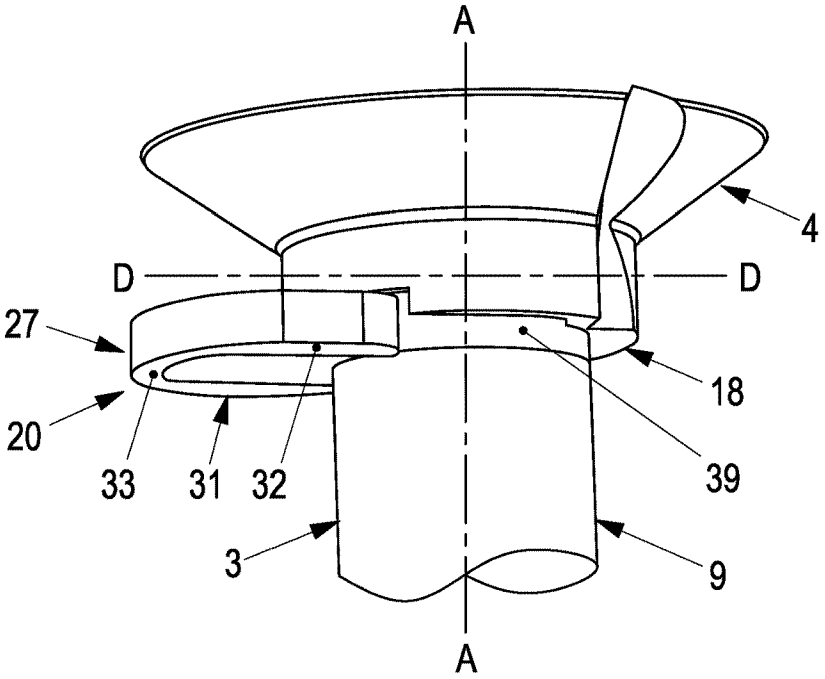
FIG. 7 shows a first installation position of the insert element as per FIGS. 2 and 3.
Figure 9:
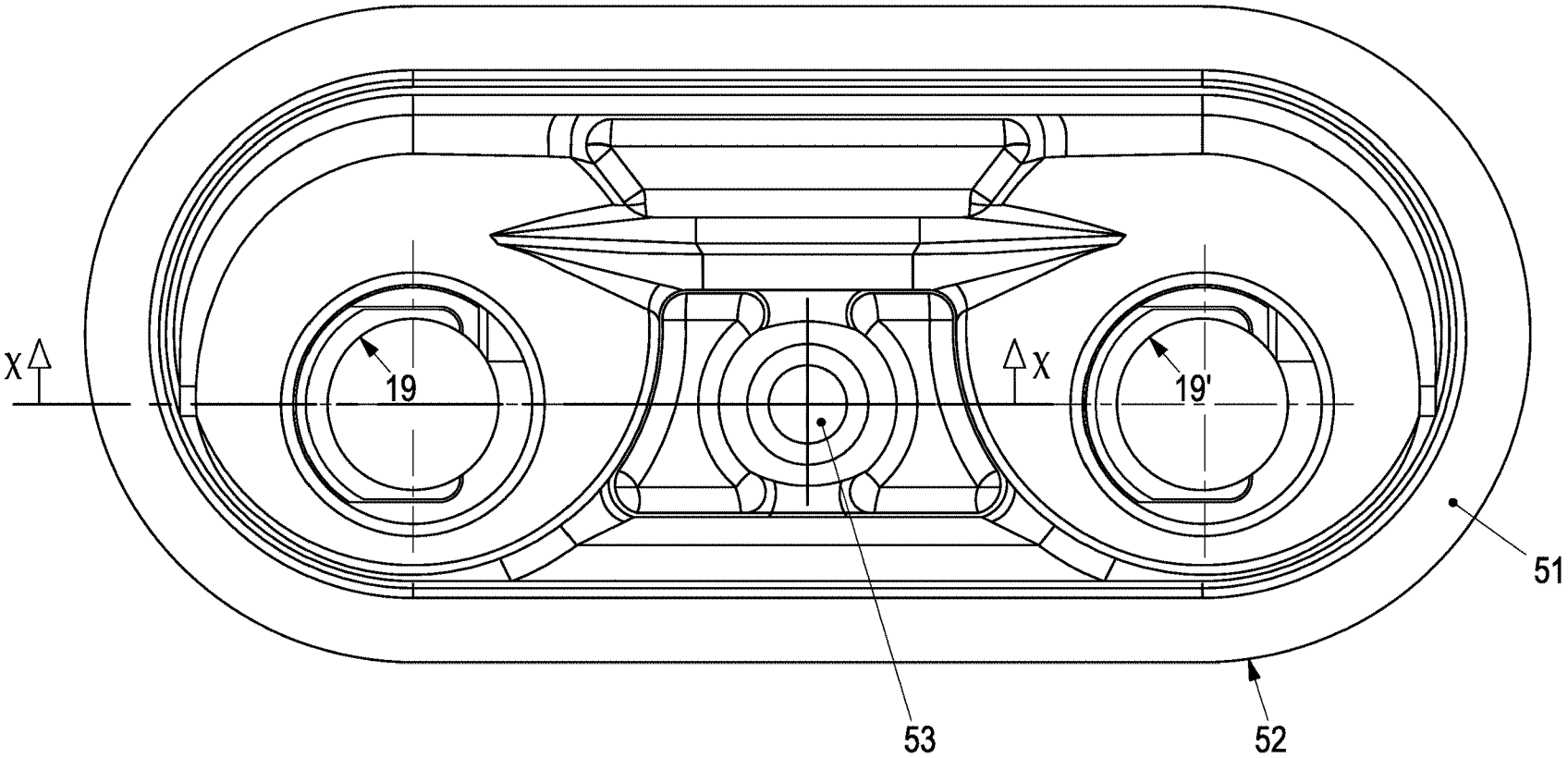
FIG. 9 shows a view approximately in the arrow direction Z of FIG. 1.
Figure 10:
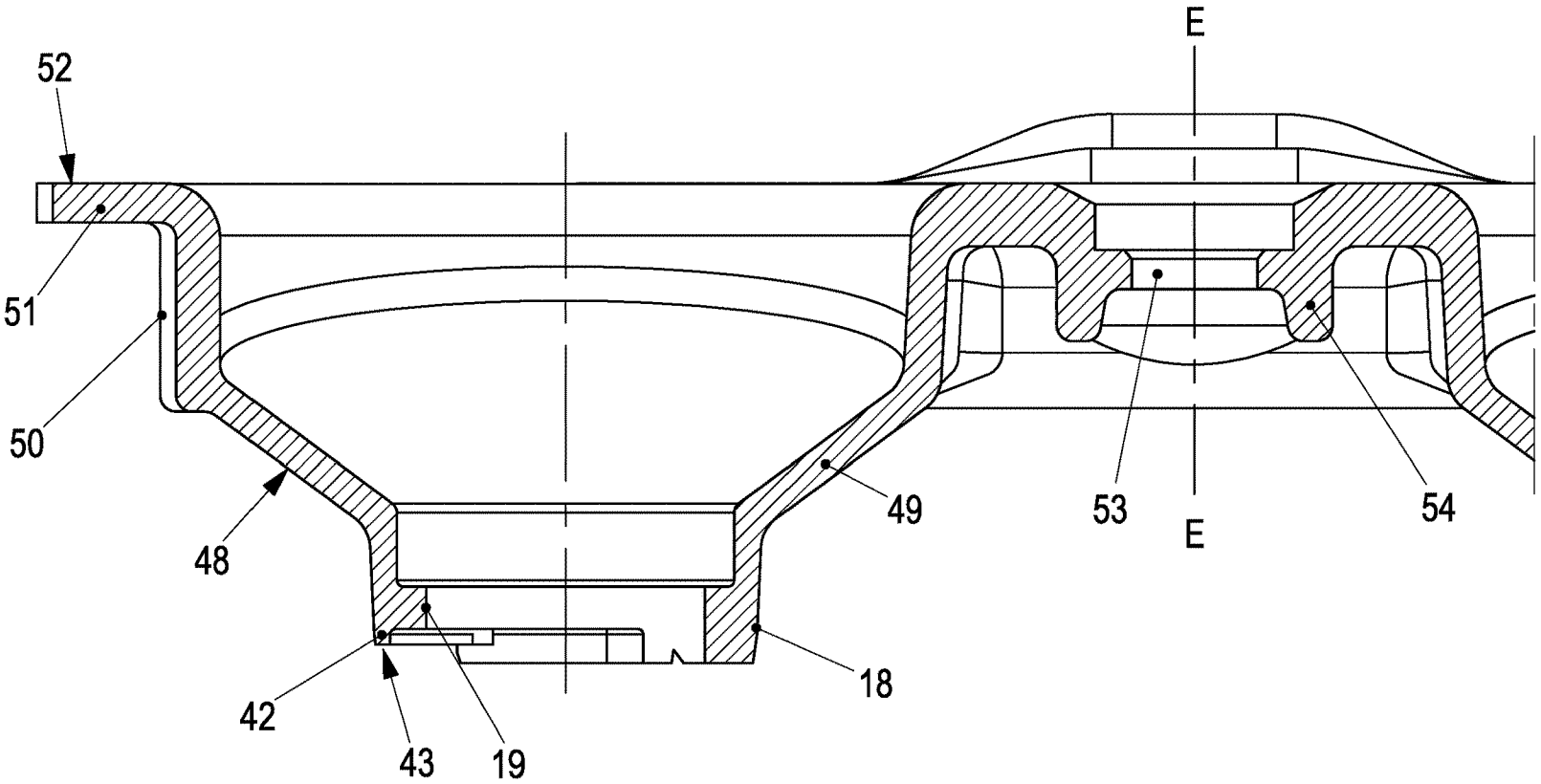
FIG. 10 shows a section approximately along the line X-X of FIG. 9.
Figure 11:
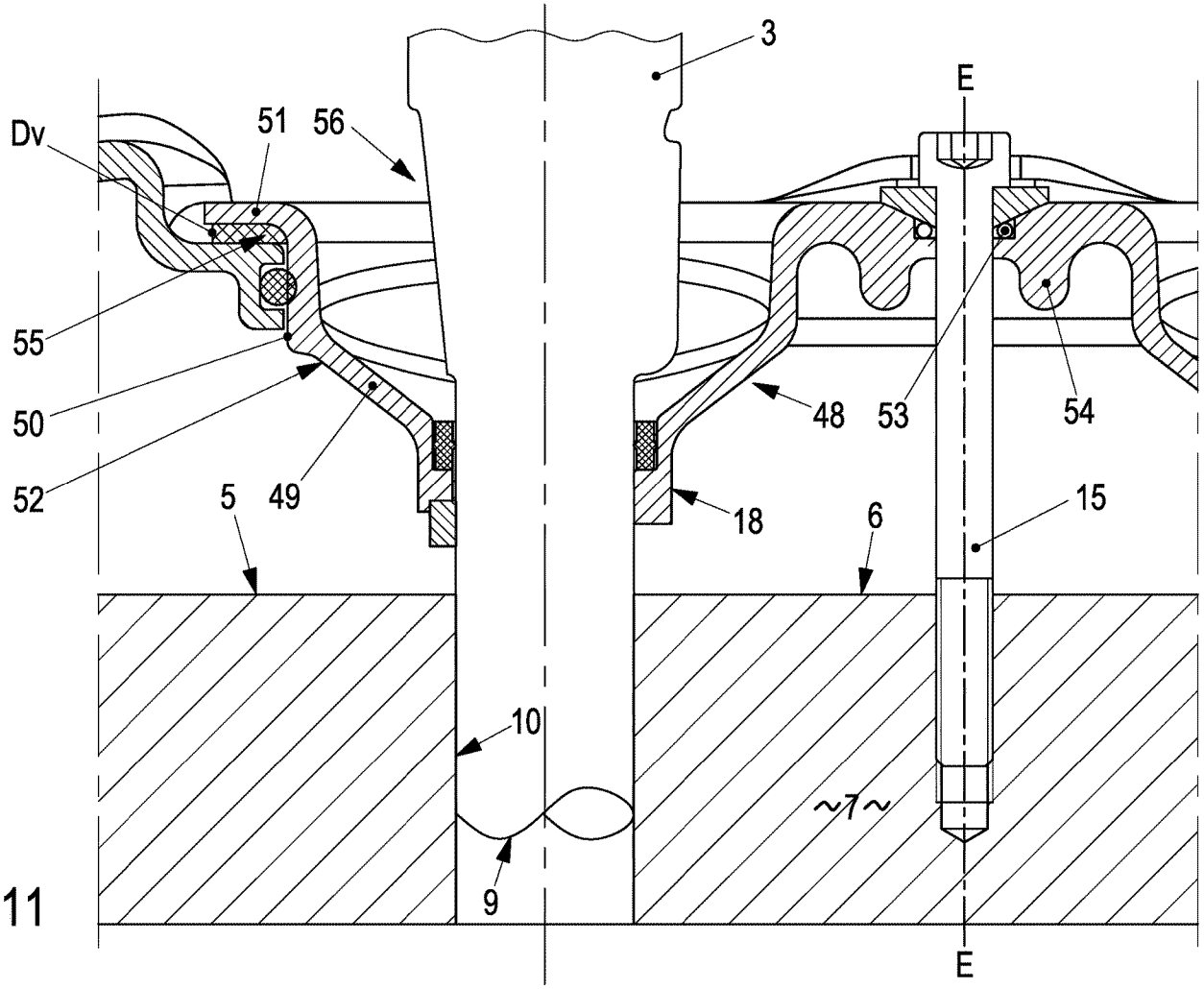
FIG. 11 shows a section along the line XI-XI of FIG. 1 on an enlarged scale.

The spring system 23 is formed in a ring-shaped manner between the first stop 21 of the shell body 9 and the second stop 22 of the fixing bushing 18—FIG. 6. Also, the spring system 23 includes a spring device 44 composed of rubber, elastomer or the like and a compression spring 45 composed of spring steel, which spring device and compression spring abut against one another in a radial plane F-F. The compression spring 45 is supported on the first stop 21; the spring device 44 is supported on the second stop 22. The spring device 44 is of double-T-shaped form in cross section and acts as a sealing body 46, and by way of limbs SchI and SchII connected by a transverse web Qs, between the first flattened portions 38 and 39 of the shell body 9 and the second flattened portions 40 and 41—FIGS. 4 and 6.

The fixing bushing 18 is, in the direction of a second end region 47 of the fuel injection nozzle 3, equipped with a jacket cup 48. The latter has a first, conical shell section 49 which leads away from the fixing bushing 18 and which widens proceeding from the fixing bushing 18, wherein said first shell section is adjoined by a second, cylindrical shell section 50. The second, cylindrical shell section 50 is delimited by a support flange 51. Furthermore, the fixing bushing 18, the first shell section 49, the second shell section 50 and the support flange 51 are realized as a high-strength bearing bracket 52 produced in one piece—FIGS. 2 and 3. Metal, composite material or the like are suitable materials for the bearing bracket.

The bearing bracket 52 is suitable for receiving the fuel injection nozzle 3. It is however also possible for the bearing bracket 52 to be structurally designed such that two fuel injection nozzles, specifically 3 and 3', can be fastened thereto—FIG. 2. For this purpose, the fastening bolt 15 is suitable as a single holding device, which fastening bolt holds the bearing bracket 52 in position on the housing section 5 of the engine housing 6 of the internal combustion engine 1. The fastening bolt 15 extends, in a central longitudinal plane E-E between the internal bores 19 and 19' of the fixing bushings 18 and 18' of the bearing bracket 52, through a bracket bore 53 in a turned-up reinforcement 54 of the bearing bracket 52. A sealing device Dv is provided between the support flange 51 of the bearing bracket 52 and a contact plane 55 of the housing section 5. In the exemplary embodiment, the bearing bracket 52, the fuel injection nozzles 16 and 16', the spring systems 23 and 23' and the insert elements 20 and 20' or the fixing clips 27 and 27' form a prefabricated structural unit 56—FIG. 2.

Finally, for the installation of the fixing clips 27 and 27' in the form of insert elements 20 and 20' and of the injection nozzles 3, 3', it is recommended to use the following method: the spring system 23 and subsequently the fuel injection nozzle 3, for example, are inserted into the fixing bushing 18. Then, the spring system 23 is subjected, via the first stop 21, to load in the axial direction A-A of the fuel injection nozzle 3 such that the fixing clip 27 can be inserted in the radial direction D-D of the fuel injection nozzle, in such a way that the axial securing collar 42 of the fixing bushing 18 engages over the transverse web 30 of the fixing clip 27 such that the fixing clip 27 is radially secured in the axial direction A-A, and the fuel injection nozzle 3 is secured both axially and radially in the bearing bracket 52, after the spring system is relieved of load. The uninstallation of the fuel injection nozzle 3 is performed in the reverse sequence.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fuel injection system for an internal combustion engine, comprising:

at least one fuel injection nozzle which, by way of a cylindrical shell body, is inserted at least in regions into a bore of a cylinder head, the at least one fuel injection nozzle being configured to feed fuel via a nozzle tip to a combustion chamber between the cylinder head and a reciprocating piston;

a holding device by which the fuel injection nozzle is held in position on a housing section of the internal combustion engine, the holding device biasing a first end region of the fuel injection nozzle against a bore stop within the bore in the cylinder head, wherein the holding device has, outside the bore, a fixing bushing to which the cylindrical shell body is fixed axially and radially by way of a radial insert element, the holding device has a spring system acting between a first radial stop of the fuel injection nozzle and a second radial stop of the fixing bushing as viewed in a longitudinal axial direction of the cylindrical shell body, and the spring system is configured to bias the fixing bushing, by way of a third radial stop of the fixing bushing, against a locking element system of the radial insert element, which is supported between the third radial stop and a fourth radial stop of the cylindrical shell body.

2. The fuel injection system as claimed in claim 1, wherein the radial insert element is in the form of a U-shaped fixing clip made up of two parallel radial limbs and a transverse web which connects said limbs, and the limbs form first and second locking elements and the transverse web form a third locking element.

3. The fuel injection system as claimed in claim 2, wherein at least the first and second locking elements have a square cross section.

4. The fuel injection system as claimed in claim 2, wherein the first and second locking elements have inner delimitations and outer delimitations as viewed in a radial direction of the shell body of the fuel injection nozzle, and the inner delimitations interact with first flattened portions of the shell body and the outer delimitations interact with second flattened portions of the fixing bushing.

5. The fuel injection system as claimed in claim 2, wherein the transverse web of the fixing clip is, as viewed in the radial direction of the shell body, fixed by an axial securing collar of the fixing bushing.

6. The fuel injection system as claimed in claim 1, wherein the spring system is formed in a ring-shaped manner between the first stop of the shell body and the second stop of the fixing bushing.

7. The fuel injection system as claimed in claim 6, wherein the spring system comprises a spring device composed of rubber or elastomer and a compression spring composed of spring steel, which spring device and compression spring are situated one behind the other in the axial direction, and the compression spring is supported against the first stop and the spring device is supported against the second stop.

8. The fuel injection system as claimed in claim 4, wherein the spring system comprises a spring device composed of rubber or elastomer and a compression spring composed of spring steel, which spring device and compression spring are situated one behind the other in the axial direction, and the compression spring is supported against the first stop and the spring device is supported against the second stop.

9. The fuel injection system as claimed in claim 8, wherein the spring device is of double-T-shaped form in cross section and, by way of limbs, acts as a sealing body between the first flattened portions of the shell body and the second flattened portions of the fixing bushing.

10. The fuel injection system as claimed in claim 1, wherein the fixing bushing is, in the direction of a second end region of the fuel injection nozzle, equipped with a jacket cup which has a first, conical shell section leading away from the fixing bushing, with a second, cylindrical shell section adjoining said first shell section.

11. The fuel injection system as claimed in claim 10, wherein the second shell section is delimited by a support flange.

12. The fuel injection system as claimed in claim 11, wherein the fixing bushing, the first shell section, the second shell section and the support flange are combined as a high-strength bearing bracket produced in one piece.

13. The fuel injection system as claimed in claim 12, wherein the bearing bracket is designed for receiving two fuel injection nozzles, a fastening bolt of the holding device extending, in a central longitudinal plane between the fuel injection nozzles, through a bracket bore, which is surrounded by a turned-up reinforcement of the bearing bracket, for fastening the bearing bracket to the housing section of the engine housing of the internal combustion engine.

14. The fuel injection system as claimed in claim 13, wherein a sealing device is provided between the support flange and a contact plane of the housing section of the engine housing.

15. The fuel injection system as claimed in claim 13, wherein the bearing bracket, the two fuel injection nozzles, and the spring systems and the radial insert elements associated with respective ones of the two fuel injection nozzles, form a prefabricated structural unit.

16. A method of installing fixing clips, which are in a form of the radial insert element, as claimed in claim 12, the method comprising the acts of: inserting the spring system and, subsequently, the fuel injection nozzle into the fixing bushing; then subjecting the spring system, via the first stop, to a load in the axial direction of the fuel injection nozzle; and inserting the fixing clip in the radial direction, such that the securing collar of the fixing bushing engages over the transverse web of the fixing clip so that the fixing clip is radially secured in the axial direction after the spring system is relieved of the load.

* * * * *